US006611982B2

(12) United States Patent
Eberl et al.

(10) Patent No.: US 6,611,982 B2
(45) Date of Patent: Sep. 2, 2003

(54) MILITARY QUICK LAUNCHING BRIDGE SYSTEM

(75) Inventors: Klaus Eberl, St. Julian (DE); Werner Fraundorfer, Bedesbach (DE)

(73) Assignee: General Dynamics Santa Bárbara Sistemas GmbH, Kaiserslautern (DE)

( * ) Notice: Subject to any disclaimer, the term of this patent is extended or adjusted under 35 U.S.C. 154(b) by 0 days.

(21) Appl. No.: 10/160,439

(22) Filed: May 31, 2002

(65) Prior Publication Data

US 2002/0178518 A1 Dec. 5, 2002

(30) Foreign Application Priority Data

Jun. 2, 2001 (DE) ..... 101 27 136

(51) Int. Cl.[7] ..... E01D 15/10
(52) U.S. Cl. ..... 14/2.5; 14/2.4
(58) Field of Search ..... 14/2.4, 2.5, 2.6, 14/26

(56) References Cited

U.S. PATENT DOCUMENTS

| | | | | | |
|---|---|---|---|---|---|
| 2,556,175 | A | | 6/1951 | Frost | |
| 3,562,829 | A | * | 2/1971 | Soffge | 14/2.4 |
| 3,754,293 | A | * | 8/1973 | Wagner et al. | 14/2.5 |
| 3,925,840 | A | * | 12/1975 | Wagner | 14/2.5 |
| 4,288,881 | A | * | 9/1981 | Mahncke et al. | 14/2.5 |
| 4,299,002 | A | * | 11/1981 | Wagner et al. | 14/2.4 |
| 4,493,122 | A | * | 1/1985 | Echtler et al. | 14/2.4 |
| 4,602,399 | A | * | 7/1986 | Jenkins | 14/2.4 |
| 4,663,793 | A | * | 5/1987 | Parramore | 14/2.5 |
| 5,042,102 | A | | 8/1991 | Kahmann | |
| 5,063,630 | A | * | 11/1991 | Wiedeck | 14/2.4 |
| 5,107,561 | A | * | 4/1992 | Huther | 14/2.4 |
| 5,329,652 | A | * | 7/1994 | Wiedeck et al. | 14/5 |
| 5,732,430 | A | * | 3/1998 | Beitz et al. | 14/2.5 |
| 5,937,468 | A | * | 8/1999 | Wiedeck et al. | 14/2.5 |

FOREIGN PATENT DOCUMENTS

| | | | |
|---|---|---|---|
| DE | 37 37 680 | * | 5/1989 |
| DE | 195 24 062 | * | 9/1996 |

* cited by examiner

*Primary Examiner*—Gary S. Hartmann
(74) *Attorney, Agent, or Firm*—Friedrich Kueffner

(57) ABSTRACT

A military quick launching bridge system has a bridge with two track supports and a laying mechanism, having an advancing support with two support sections A laying device cooperates with the laying mechanism and has a hydraulic device, a cable pull, and an electronic control. The track supports have parallel ramps with transverse pipes near their ends, and the support sections have transverse beams near their ends engaging the transverse pipes of the ramps. A pin wheel gear is provided on the advancing support. The support sections have running surfaces for supporting rollers of the laying device. The laying device has a transverse transporter with a telescoping pipe on gliding plates, supporting rollers for the ramps on the telescope pipe, and drivers adjacent to the supporting rollers. Expanding cylinders extend and retract the telescoping pipe and the ramps.

18 Claims, 4 Drawing Sheets

MILITARY QUICK LAUNCHING BRIDGE SYSTEM

BACKGROUND OF THE INVENTION

1. Field of the Invention

The invention relates to a military quick launching bridge system, transportable by means of aircraft, rail vehicles, water craft, and/or land craft, and layable cantilevered. The system comprises essentially a bridge, comprised of two track supports which are connectable by a coupling with one another and a laying mechanism; a laying device which is correlated with the laying mechanism and comprises a hydraulic device, a cable pull, and an electronic control; and an advancing support; wherein the track supports has two parallel ramps connected by a support section.

2. Description of the Related Art

Such quick launching bridge systems have been used for decades by many armed forces. Bridges with a large span of more than 20 meters are known, for example, under the name "Biber" and "Leguan". See, for example, DE 44 34 027 C, DE 41 23 092 A, EP 0 347 019 A, and U.S. Pat. No. 5,042,102.

Bridges with a smaller span can be transported on trucks and can be launched from the truck. This is described in U.S. Pat. No. 2,556,175, DE 39 32 742 C, EP 0 391 149 B, EP 0 407 235 A, or DE 40 09 354 A.

In all of these bridge types, which are laid cantilevered, particular consideration is given to the parts which are required for the cantilevering action. The mechanism must be configured such that it can receive the forces which occur during free advancing by cantilevering so that the bridge can be moved without jamming or canting and so that no premature wear occurs. For this purpose, the laying or launching vehicles have pairs of support rolls which cooperate with corresponding running surfaces on the bridge and enable the movement of the bridge. Moreover, motors and gear boxes are provided in order to set the bridge in motion. Finally, devices are provided on the transport and launching vehicles which enable coupling of the bridge disassembled during transport.

DE 40 09 354 A discloses a launching system, substantially comprised of a launching vehicle, an advancing frame, a laying arm, and an auxiliary arm, for a demountable track support bridge with a cantilever support arranged between the side girders. The individual bridge sections are coupled during assembly. The two sections of the track support, provided in each bridge section, and the section of the cantilever support comprised of two halves are movable in a transverse direction. For transporting them, they are telescoped into one another and, for installing them, they are extended. The track supports and the cantilever support have U-shaped cross-sections with vertical frame projections and frame transoms at the top. The frame transoms of the cantilever frame cross-section and the transverse beams are removable. As an alternative, the frame transoms of the cantilever support and the transverse beams can have two terminal hinges and a central hinge with locking possibilities and are then foldable for transport. With such a bridge it is possible to reduce the so-called transport profile of the vehicle and the bridge. However, the disclosed configuration is still very complex, and this is unsatisfactory.

SUMMARY OF THE INVENTION

It is an object of the present invention to provide a quick launching bridge system of the aforementioned kind which is of a significantly simplified configuration and which, moreover, is not only launchable with a specially configured launching vehicle but can be laid substantially with all land craft which are configured for pallet operation.

In accordance with the present invention, this is achieved in that:

- on the ramps at the front and the rear a transverse pipe is mounted;
- the cantilever support is provided with a pin wheel gear, transverse beams extending to the right and to the left at the front and the rear for engaging the transverse pipes, and running surfaces for support rolls of the laying device;
- the laying device comprises a transverse transporter with a telescoping pipe on gliding plates, supporting rollers for the ramps on the telescoping pipe, and drivers adjacent to the transport rollers which cooperate with the ramps; and
- expanding cylinders for extending and retracting the telescoping pipe and the ramps.

As a result of this configuration, the quick launching bridge system is suitable for tactical use in the case of small and average bridge spans without requiring preparation of the (river) banks. By means of the provided electronic control, the bridge can be launched by two soldiers within a maximum period of time of 10 minutes. The recovery can be achieved in about the same amount of time.

The transport can be carried out with all vehicles having sufficient transport capacity, i.e., also by means of aircraft, rail vehicles, or water craft.

The bridge according to the invention is laid cantilevered from the vehicle, preferably from a truck. For this purpose, the bridge sections are horizontally extended, coupled, and placed horizontally across the obstacle. As a result of the low aspect ratio, reconnaissance by the enemy is made difficult.

According to the invention, the bridge can also be transported by airplanes and helicopters wherein, in this connection, the capability of width reduction of the bridge during transport is particularly advantageous.

For rail transport, a predetermined tunnel profile can be maintained without problem. Special transport vehicles are not required.

According to one embodiment of the invention, the advancing support has a hat-shaped profile. Such a profile can be easily dimensioned such that during cantilevering the resulting bending forces can be safely received. Moreover, the lateral edges can be used as running surfaces for the support rolls of the laying device.

According to a preferred embodiment, the pin wheel is arranged to be protected in a recess within the hat-shaped profile.

Preferably, the transverse pipes in the ramps and the transverse beams on the advancing support are in the form of square pipes.

On the longitudinal ramp edge facing the central gap a guard rail can be provided. It provides a guiding function particularly for smaller vehicles. When eliminating a guard rail also on the outer edges of the ramps, cleaning of the bridge surface can be substantially simplified.

Advantageously, the ramps are comprised of a U-shaped profile open downwardly wherein the tapered ends of the ramps are closed at the bottom. As a result of the downwardly open configuration, the required torsional yielding is achieved which enables an optimal adaptation of the tapered ramp ends to the respective (river) bank. Since the tapered ramp ends are closed, the required support surface for transferring the traffic load is ensured even for banks that are not prepared.

Preferably, the surface of the ramps serving as the roadway have a slip-reducing coating.

Advantageously, the ramps are comprised of light metal. This reduces the weight so that even relatively long bridges can be launched cantilevered without requiring special launching vehicles, for example, a launching tank.

Because of the high load, the advancing support is advantageously comprised of steel.

In order to ensure a universal deployment by means of aircraft, rail vehicles, water craft and/or land craft, a suitable laying device is provided according to another embodiment of the invention. The laying device comprises, in addition to the above-mentioned transverse transporter, a first pin wheel gear with drive motor, gearbox and pinion; a forward lifting device with lifting arm, support rolls, centering plates and lifting cylinder; a rearward lifting device with lifting arm, support rolls, centering plates, and lifting cylinder; a cable pull with cable and motor-driven cable drum and a rearward laying arm with lower and upper supporting rollers which cooperate with the running surfaces of the advancing support; and a second pin wheel gear comprising a drive motor, gearbox, and pinion. In this connection, the laying arm is mounted on an axle and pivotable by means of a pivot cylinder between an approximately vertical upwardly pointing position and approximately vertical downwardly pointing position and can be locked in any pivot position.

According to a further embodiment, the pivot cylinder for the laying arm acts via a pivot lever which is rotatably mounted on the axle of the laying arm. For lifting the bridge, this pivot lever engages positive-lockingly the laying arm. The upward pivoting of the laying arm without load into the stowing position is carried out by a pivot drive arranged between the pivot lever and the laying arm. The pivot cylinder is in its free-running position.

As a result of the special loading situation of the laying arm, the laying arm as well as the pivot lever are preferably made of steel.

In order to enable the universal transportability of the bridge, the laying device can be mounted on a transport pallet or integrated into a transport pallet. The transport pallet can then be transported with the laying device and the disassembled bridge without special adaptation by means of any aircraft, rail vehicle, water craft and/or land craft.

According to one embodiment, the transport pallet has a pallet frame comprised of two longitudinal supports and two transverse supports, a forwardly attached support with a hook receptacle for connecting to the transport vehicle, holders for the cable drum, and guides for the track support positioned on top.

Advantageously, the transverse support carry the transverse transporter which, in turn, supports and moves the ramps.

Advantageously, the transport pallet is a steel construction.

Moreover, the transport pallet comprises a diesel-electric-hydraulic apparatus, the hydraulic device, the electric control, the expanding cylinders, and/or the support legs with the correlated support cylinders.

Advantageously, the transport pallet has additional support wheels.

According to one embodiment, all hydraulic cylinders our are configured as differential cylinders which, on the one hand, enable a quick adjustment and, on the other hand, enable a high force output.

DESCRIPTION OF THE PREFERRED EMBODIMENTS

Figure 1:
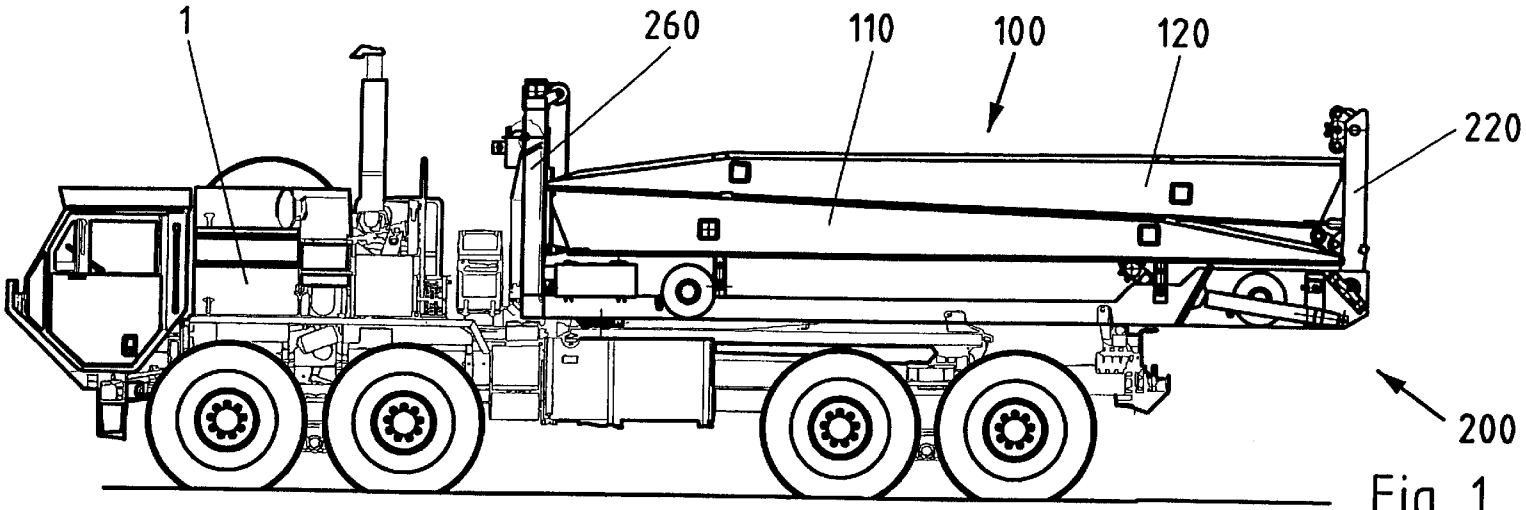
FIG. 1 shows a side view of land craft with a military quick launching bridge system in a transport position.
Figure 2:
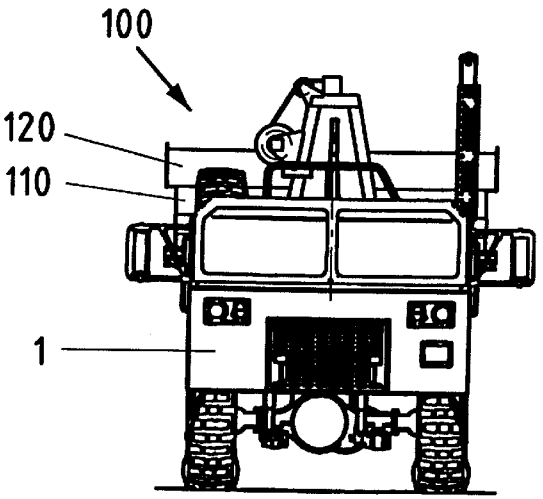
FIG. 2 shows the transport vehicle according to FIG. 1 in a front view.
Figure 3:
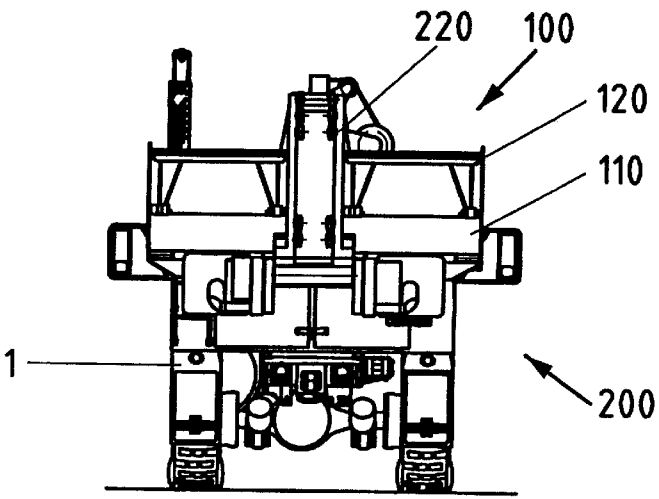
FIG. 3 shows the transport vehicle according to FIGS. 1 and 2 in a view from the rear.

FIGS. 1, 2, and 3 show a transport vehicle in a side view, in a view from the front, and a view from the rear. A transport pallet 200 is mounted on the frame of the transport vehicle 1 and, in turn, supports the bridge 100 collapsed into its transport position. Two track supports 110, 120 of the quick launching bridge 100 are fixed in position between a forward support 260 and a rearward laying arm 220.

Figure 4:
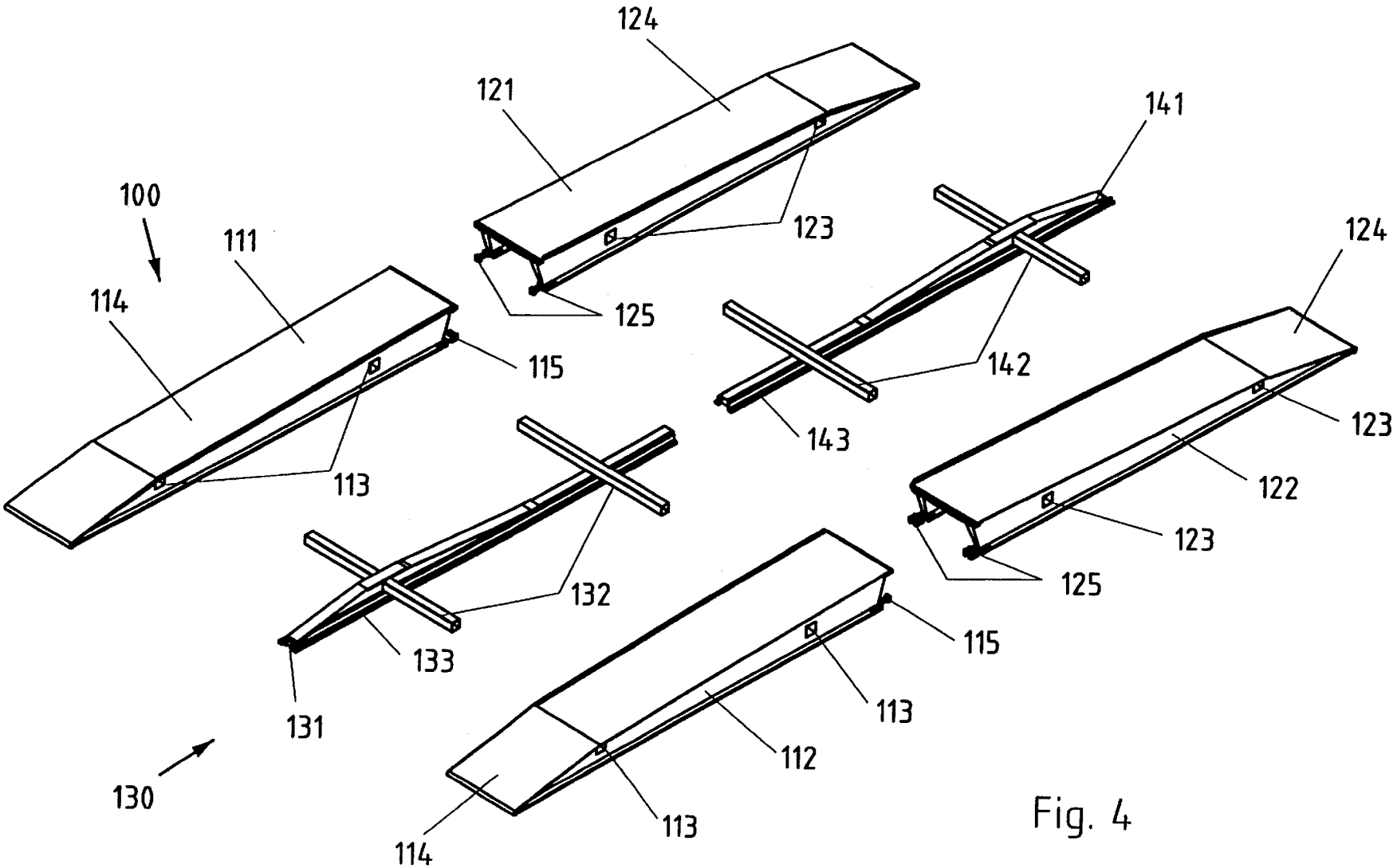
FIG. 4 shows a quick launching bridge disassembled into its individual parts.

FIG. 4 shows the quick launching bridge 100, which can be launched cantilevered, in a state in which it is disassembled into its individual parts. The four ramps 111, 112; 121, 122 can be seen whose upper sides 114, 124 are provided with a slip-resistant roadway coat. Two ramps 111, 121; 112, 122 can be coupled, respectively, by means of couplings 115, 125 to a complete track.

Between the ramps an advancing support 130 is illustrated which is comprised of two elements 131, 141. It has a hat-shaped profile in which at the bottom side a pin wheel gear (not illustrated) is arranged in a protected fashion. The lateral surfaces 133, 143 of the hat-shaped profile serve as running surfaces for supporting rollers 222, 233 of the laying device 200 (FIG. 6).

Transverse beams 132, 142 are mounted at the front and the rear on each one of the advancing support elements 131, 141. They engage transverse pipes 113, 123 which are welded to the ramps 111, 112; 121, 122 below the roadway 114, 124. In this way, the ramps can be pushed together for transport so that the transport profile (contour) can be reduced.

Figure 5:
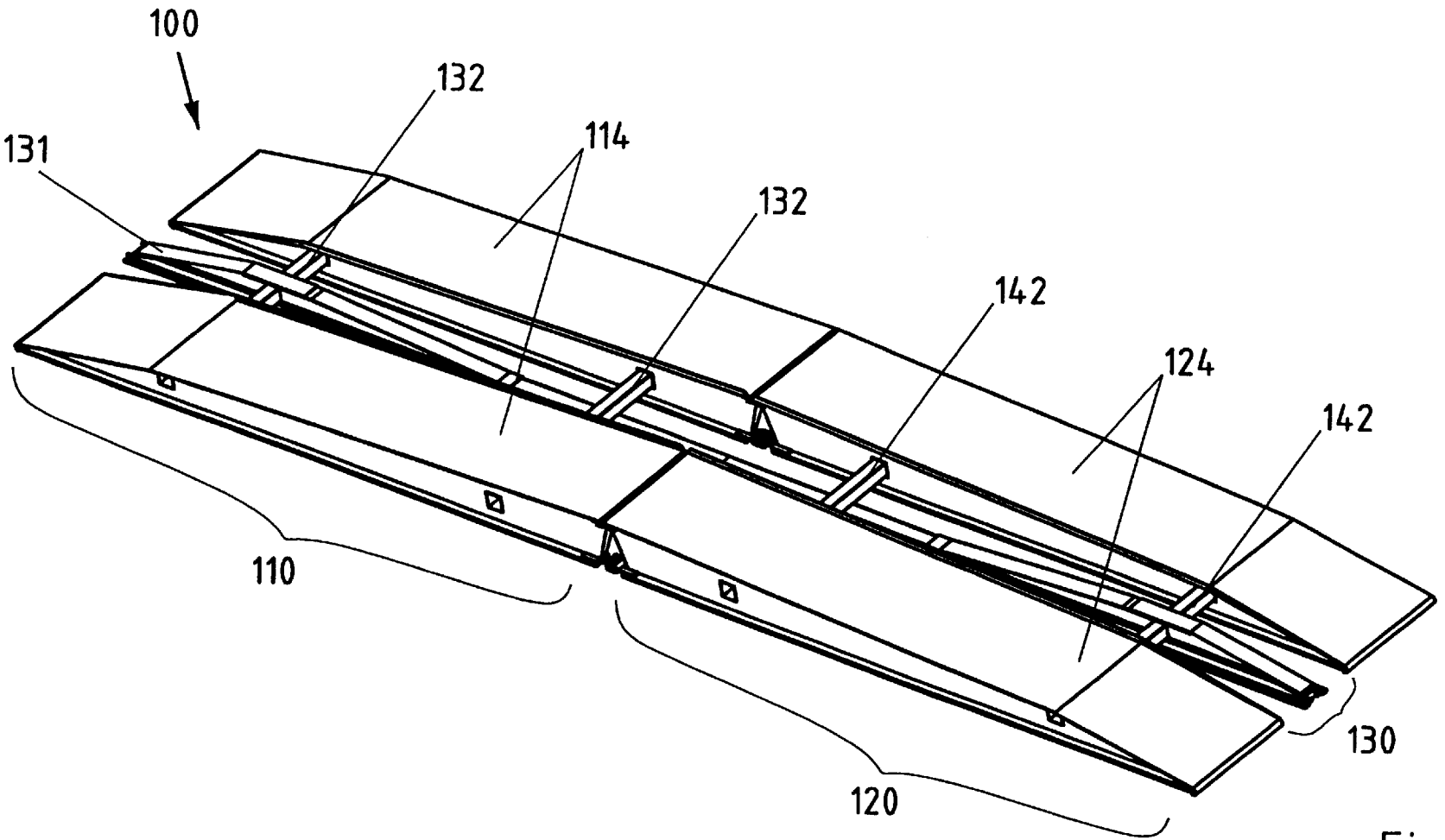
FIG. 5 shows the launching bridge in the assembled state.

FIG. 5 shows the quick launching bridge 100 which can be laid cantilevered in is completely assembled state. The two track supports 110, 120 are coupled and secured on the transverse beams 132, 142 of the advancing support 130.

Figure 6:
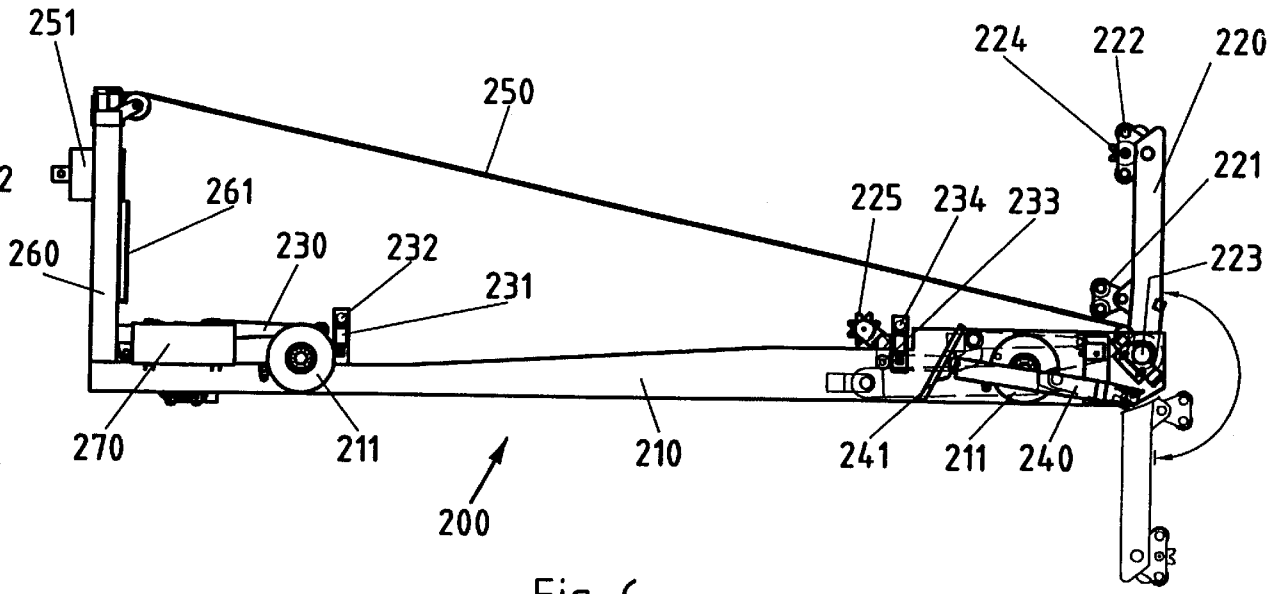
FIG. 6 shows the transport pallet of FIG. 1 without quick launching bridge in a side view.
Figure 7:
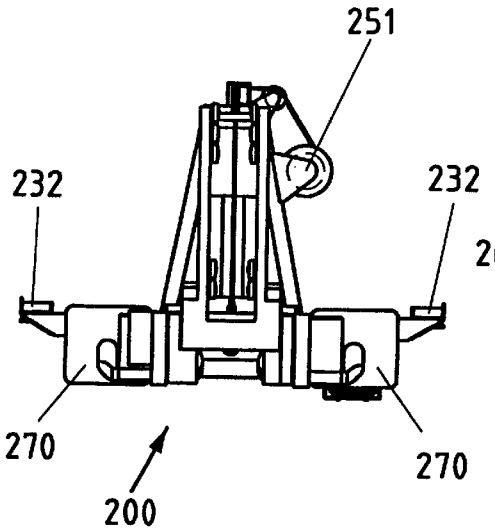
FIG. 7 shows the transport pallet of FIG. 6 from behind.

FIG. 6 shows a side view and FIG. 7 a rear view of the laying device 200 in the form of a transport pallet. It has a pallet frame 210 of to longitudinal beams and two transverse beams (not illustrated), a forwardly attached support 260 and a laying arm 220 pivotably supported at the rear. The transport pallet is moreover provided with: support wheels 211, support legs 241 which can be activated by means of a pivotably arranged support cylinder 240, a hydraulic device 270, and an electronic control (not illustrated). Supplying the hydraulic device and the electronic device is realized by suitable connectors via the transport vehicle 1.

On the forward support 260 a motor-driven cable drum 251 for a cable pull 250 is provided. This cable pull 250 assists in the recovery of the deployed quick launching bridge 100. Moreover, at the forward support 260 a holder 261 for securing the track support 120 (FIG. 1) positioned on top is provided.

On the pallet frame 210, moreover, a forward auxiliary arm 230 and a rearward auxiliary arm (not illustrated) with support rolls 231, 233 and centering plates 232, 234 are provided. The track support 110 (FIG. 1) is moved on the support rolls 231, 233. By means of the centering plates 232, 234, the ramps 111, 112; 121, 122 are pushed together before transport and are spread apart again for launching. This movement is realized by expanding cylinders which are supported within the pallet frame 210.

In the rearward area of the transport pallet 200 a first pin wheel gear with drive motor, gearbox, and pinion 225 is provided which cooperates with the pin wheel gear at the bottom side of the advancing support 130.

A second pin wheel gear with drive motor, gearbox, and pinion 224 is provided on the laying arm 220. It supports also upper supporting rollers 221 and, at a spacing thereto, lower supporting rollers 222 which enable, together with the running surfaces 133, 143 on the advancing support 130, the free advancing of the cantilevered quick launching bridge 100.

The laying arm 220 is supported on a transversely extending axle 223 and can be pivoted by means of a hydraulic cylinder (not illustrated) between an approximately vertical upwardly pointing position, shown in the drawing, and an approximately vertical downwardly pointing position. It can be locked in any angle position or pivot position.

While specific embodiments of the invention have been shown and described in detail to illustrate the inventive principles, it will be understood that the invention may be embodied otherwise without departing from such principles.

What is claimed is:

1. A military quick launching bridge system, transportable by means of aircraft, rail vehicles, water craft, and land craft, and layable cantilevered; the bridge system comprising:

a bridge comprised of two track supports, configured to be connected with one another by a coupling in a longitudinal direction of the track supports, and a laying mechanism, comprising an advancing support extending in the longitudinal direction of the track supports and comprising two support sections;

a laying device cooperating with the laying mechanism and comprising a hydraulic device, a cable pull, and an electronic control;

wherein each one of the track supports is comprised of two parallel ramps and wherein the two parallel ramps are connected by one of the two support sections, respectively;

wherein the ramps have transverse pipes mounted near opposed ends of the ramps in the longitudinal direction, respectively, and wherein the support sections have transverse beams mounted near opposed ends of the support sections in the longitudinal direction, respectively, and engaging the transverse pipes of the ramps;

wherein the laying mechanism has a pin wheel gear provided on the advancing support;

wherein the support sections have running surfaces for supporting rollers of the laying device;

wherein the laying device comprises a transverse transporter, the transverse transporter comprising a telescoping pipe on gliding plates, supporting rollers for the ramps on the telescope pipe, and drivers adjacent to the supporting rollers; and wherein the laying device further comprises expanding cylinders for extending and retracting the telescoping pipe and the ramps.

2. The bridge system according to claim 1, wherein the advancing support has a hat-shaped profile.

3. The bridge system according to claim 1, wherein the pin wheel gear of the laying mechanism has is arranged in a protected position in the advancing support.

4. The bridge system according to claim 1, wherein the transverse pipes and the transverse beams are square pipes.

5. The bridge system according to claim 1, wherein the ramps have longitudinal edges facing the advancing support and wherein the longitudinal edges have guide rails.

6. The bridge system according to claim 1, wherein the ramps are comprised of a U-shaped downwardly open profile and have tapered ends, wherein the tapered ends of the ramps are downwardly closed.

7. The bridge system according to claim 1, wherein the ramps have top surfaces providing a roadway, wherein the top surfaces are provided with a slip-resistant coat.

8. The bridge system according to claim 1, wherein the ramps are comprised of light metal and the advancing support is comprised of steel.

9. The bridge system according to claim 1, wherein the laying device further comprises:

a first pin wheel gear with a drive motor, a gearbox, and a pinion;

a first lifting device with a first lifting arm, first support rolls, first centering plates, and a first lifting cylinder;

a second lifting device with a second lifting arm, second support rolls, second centering plates, and a second lifting cylinder, wherein the second lifting device is located remote from the first lifting device;

wherein the cable pull comprises a cable and a motor-driven cable drum;

a laying arm arranged near the second lifting device, wherein the supporting rollers are arranged on the laying arm and comprise lower supporting rollers and upper supporting rollers;

a second pin wheel gear with a drive motor, a gearbox, and a pinion;

wherein the laying arm is mounted on an axle and is configured to be pivoted by a pivot cylinder between an approximately vertical upwardly pointing position and an approximately vertical downwardly pointing position; and wherein the laying arm is lockable in any pivoted position into which the laying arm is pivoted by the pivot cylinder.

10. The bridge system according to claim 9, wherein the pivot cylinder acts via a pivot lever onto the laying arm and wherein the pivot lever is laterally movable on the axle.

11. The bridge system according to claim 10, further comprising a transport pallet, wherein the laying device is mounted on the transport pallet.

12. The bridge system according to claim 11, wherein the transport pallet comprises a pallet frame comprised of two longitudinal supports and transverse supports connecting the longitudinal supports, wherein a first one of the two longitudinal supports comprises a forwardly attached support having a hook receptacle configured to provide a connection to a transport vehicle, wherein the forwardly attached support has holders for receiving the cable drum, and guides for one of the track supports positioned at the top when in a transport position.

13. The bridge system according to claim 12, wherein the transverse supports carry the transverse transporter.

14. The bridge system according to claim 11, wherein at least one of the transport pallet, the laying arm, and the pivot lever is comprised of steel.

15. The bridge system according to claim 11, wherein the transport pallet further comprises a diesel-electric-hydraulic apparatus.

16. The bridge system according to claim 11, wherein the transport pallet comprises support legs with support cylinders.

17. The bridge system according to claim 11, wherein the transport pallet comprises support wheels.

18. The bridge system according to claim 9, wherein the expanding cylinders, the first and second lifting cylinders, and the pivot cylinder are differential cylinders.

* * * * *